United States Patent [19]

Wilson et al.

[11] Patent Number: 4,491,998

[45] Date of Patent: Jan. 8, 1985

[54] SCRUBBER MOP

[75] Inventors: Frank G. Wilson, Malvern; William A. Patton, Newtown Square, both of Pa.

[73] Assignee: Kendo Products Co., Inc., Paoli, Pa.

[21] Appl. No.: 533,731

[22] Filed: Sep. 21, 1983

[51] Int. Cl.[3] ..... A47L 13/144

[52] U.S. Cl. ..... 15/119 A

[58] Field of Search ..... 15/105, 118, 119 R, 15/119 A, 111, 114, 116 R, 116 A

[56] References Cited

U.S. PATENT DOCUMENTS

| | | | |
|---|---|---|---|
| 603,999 | 5/1898 | Ballam | 15/116 |
| 1,424,291 | 8/1922 | Frank | 15/111 |
| 1,818,917 | 8/1931 | Wolf | 15/105 |
| 2,251,384 | 8/1941 | Thomas | 15/119 A |
| 2,683,886 | 7/1954 | Neumann | 15/118 |
| 2,858,557 | 11/1958 | Zottola | 15/119 A |
| 2,916,754 | 12/1959 | Zottola | 15/116 A |
| 3,097,384 | 7/1963 | Clark | 15/111 |
| 3,345,667 | 10/1967 | Blum | 15/119 A |
| 3,727,259 | 4/1973 | Wilson | 15/119 A |
| 3,795,933 | 3/1974 | Seufort | 15/114 |

FOREIGN PATENT DOCUMENTS

| | | | |
|---|---|---|---|
| 0496850 | 7/1900 | Belgium | 15/119 A |
| 0532768 | 11/1954 | Belgium | 15/119 A |
| 0182845 | 8/1955 | Fed. Rep. of Germany | 15/119 A |
| 0925441 | 9/1947 | France | 15/118 |
| 1025185 | 1/1953 | France | 15/119 A |
| 0697400 | 9/1953 | United Kingdom | 15/119 |

*Primary Examiner*—Chris K. Moore

*Attorney, Agent, or Firm*—Walter B. Udell

[57] ABSTRACT

An abrasive scrubbing pad device combined with a wringer mop in which the scrubbing pad when not in use is automatically placed in a physical position which does not interfere with the normal mop function of the mop by an automatic pivoting action brought into operation by actuation of the crank handle of the wringer mop. When the crank handle of the wringer mop is moved to the position where the mop head is functional for mopping purposes, the scrubber pad is pivoted out of the way, and when the actuating handle is operated to retract the mop head between the wringer rollers during a squeeze-out operation, the scrubber pad is pivoted into its operating position. The scrubber pad may be incorporated into the mop when originally asssembled or may be added to the mop at a later time. The scrubber pad structure is formed so that the scrubber pad itself may be replaced in the support structure when the pad has been rendered no longer useful by virtue of wear.

30 Claims, 10 Drawing Figures

10
11
12
14
15
16
17
18
19
20
21
22
23
32
33
34
3

FIG. 5
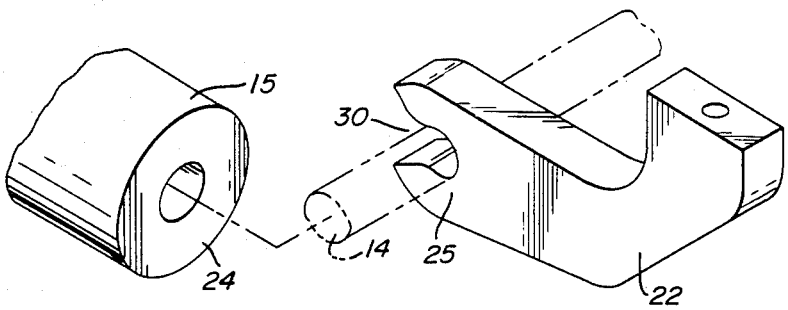
FIG. 6
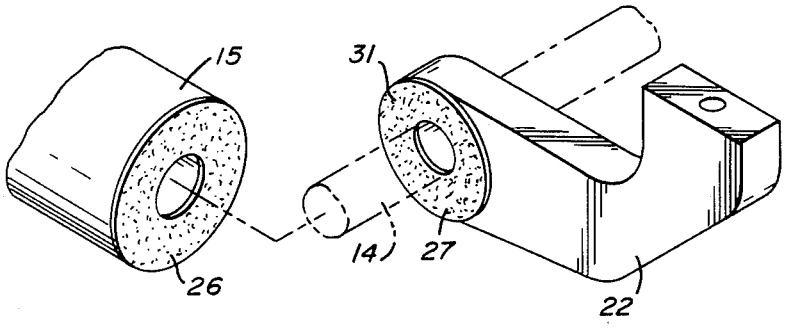
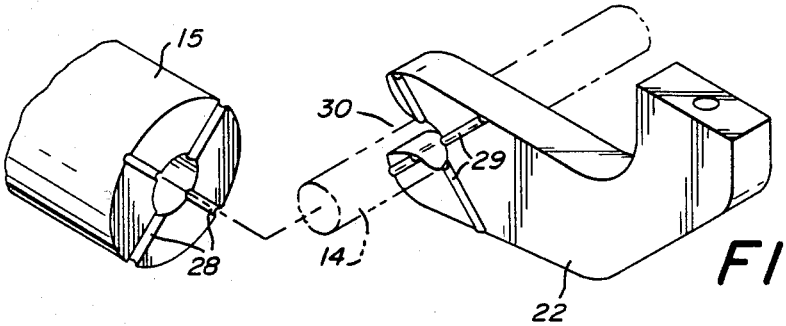
FIG. 7
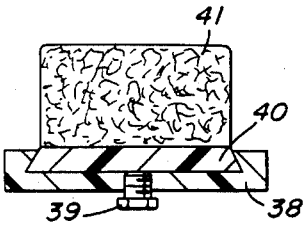
FIG. 8
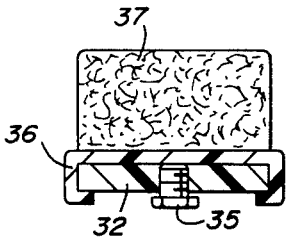
FIG. 9

SCRUBBER MOP

This invention relates generally to scrubber mops and more particularly relates to a novel mop head structure in the form of an attachment scrubber head.

The attachment scrubber head is an adjunct device for use in conjunction with sponge wringer mops of the type shown and described in U.S. Pat. No. 3,727,259 of Frank G. Wilson. Sponge wringer mops of the type shown in the Wilson patent are not themselves new, and while functioning well for their purposes, do not provide the ability to scrub hardened or resistant dirt off of the surface to be cleaned. There are also known scrubber type devices utilizing abrasive surface fiber pads which are very effective for removing hardened or stubborn dirt deposits.

The apparatus according to the invention provides the means for utilizing an abrasive pad, when desired, as a scrubbing device in conjuction with the wringer mop, and when not in use to be automatically placed in a physical position which does not interfere with the normal mop function of the mop. This is accomplished by an automatic pivoting action brought into operation by actuation of the crank handle of the wringer mop. When the crank handle of the wringer mop is moved to the position where the mop head is functional for mopping purposes, the scrubber pad is pivoted out of the way, and when the actuating handle is operated to retract the mop head between the wringer rollers during a squeeze-out operation, the scrubber pad is pivoted into its operating position.

The scrubber head device may be incorporated into the mop when originally assembled or may be added to the mop at a later time. The scrubber head structure is formed so that the scrubber pad itself may be replaced in the support structure when the pad has been rendered no longer useful by virtue of wear. Accordingly, it is a primary object of the invention to provide a novel wringer mop incorporating a separate scrubber head structure usable alternatively with the mop head.

Another object of the invention is to provide a novel scrubber pad add-on structure for use with existing wringer sponge mops of the handle crank operated type.

A further object of the invention is to provide a novel scrubber pad structure which cooperates with the normal operating mechanism of wringer sponge mops so as to be in an operative position when the sponge mop head is retracted, and to be pivoted out of the way and into a non-interfering position when the mop head is extended from mopping use.

Yet another object of the invention is to provide a novel scrubber pad device in which the working portion of the scrubber pad is replaceable.

The foregoing and other objects of the invention will appear more fully hereinafter from a reading of the following specification in conjunction with an examination of the appended drawings, wherein:

FIG. 5 is an enlarged detail illustrating clip-on engagement of the scrubber pad support arms on the axles of the wringer mop squeeze rollers;

FIG. 6 is an isometric showing similar to FIG. 5 but showing a frictional interface between the end of a squeeze roller and the face of the scrubber pad support arm which faces the end of the roller, and also showing the roller axle as passing through the end of the support arm;

FIG. 7 is an isometric showing similar to FIG. 5 but showing a keyed interface between the end of a squeeze roller and the facing face of the scrubber pad support arm;

Figures 1, 2, 3, 4A, 4B:
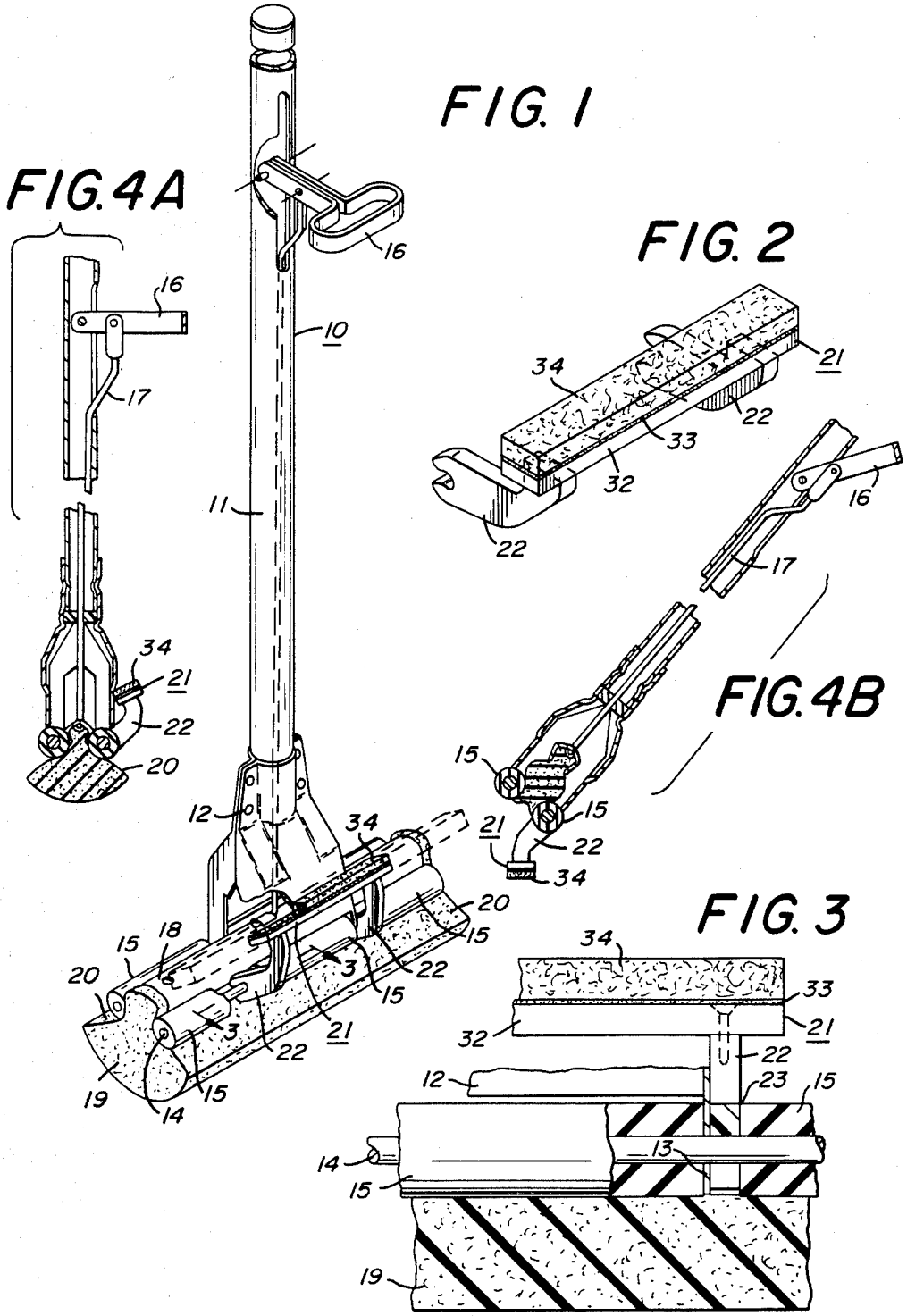
FIG. 1 is an isometric view of a mop according to the invention with the mop head shown in normal condition for mopping use and with the novel scrubber pad structure embodied therewith.
FIG. 2 is an isometric view on an enlarged scale of one form of the scrubber pad structure according to the invention shown in isolation detached from the wringer mop with which it is usable.
FIG. 3 is a partial vertical section on an enlarged scale through a portion of the mop head and wringer roller structures, showing most of the scrubber pad structure in elevation.
FIG. 4A is a side elevation of the mop according to the invention shown in FIG. 1.
FIG. 4B is a side elevation of the mop according to the invention but shown with the crank handle actuated to wring out the sponge mop head and pivot the scrubber head into operative position.

FIG. 8 is a cross sectional view through the scrubber pad and support bar on an enlarged scale compared to FIG. 2 and showing one form of replaceable scrubber pad with a locking screw, as compared to an adhesive securement of the scrubber pad shown in the structure of FIGS. 2 and 3; and FIG. 9 is a cross sectional showing through another form of scrubber pad structure illustrating a different form of replaceable pad and locking mechanism.

In the several figures, like elements are denoted by like reference characters.

Turning now to a consideration of the drawings, and first to FIGS. 1 through 4B it will be seen that the general structural and operating features of the mop are as shown and described in the previously referred to Wilson U.S. Pat. No. 3,727,259. The mop is generally designated as 10 and includes an elongated hollow handle 11 to the bottom end of which is secured a yoke 12 formed from two intersecured halves, and from the bottom of each of which yoke halves extend a pair of spaced apart legs 13. The yoke legs 13 carry the roller axles 14 upon which are fitted the roller sections 15. A crank 16 is pivotally secured to the handle 11 and carries one end of an actuating rod 17 which extends downward through the handle 11 and terminates at its lower end in a hook formation which is inserted through a receiving loop formed in the center of a channel 18 which holds the sponge mop head 19.

When the crank arm 16 is in the position shown in FIGS. 1 and 4A the actuating rod 17 pushes the mop downward into its use position. When the crank arm 16 is pulled upward as shown in FIG. 4B the actuating rod 17 moves upward and pulls the channel 18 upward between the halves of the yoke 12 and draws the sponge head 19 upward between the rollers 15. This causes the mop head to rotate the roller sections 15 because of the frictional engagement of the roller surfaces with the upper surfaces 20 of the sponge head 19 and to thereby rotate the scrubber head 21 from its "up" position shown in FIGS. 1 and 4A to its "down" or use position shown in FIGS. 4B because of the engagement of the inner ends of the outer rollers 15 with the outer side faces of the scrubber head pivot arms 22. This engagement is shown in FIG. 3 as the interface 23.

Several types of interface between the ends of rollers 15 and the pivot arms 22 are illustrated in FIGS. 5, 6 and 7. FIG. 5 illustrates an interface in which the end 24 of roller 15 is smooth and engages the surface 25 of pivot arm 22. However, since the roller 15 is typically made of rubber or non-rigid plastic, the end surface 24 is suitable for frictional engagement with the pivot arm and is operative to drive the latter.

FIG. 6 illustrates a different embodiment in which an end of the roller 15 is faced with an abrasive surface 26, and the pivot arm 22 face which engages the roller end is also provided with a facing abrasive surface 27, these two surfaces 26 and 27 providing a strong frictional engagement between the roller end and the adjacent pivot arm surface.

FIG. 7 illustrates yet a different embodiment in which the rollers and pivot arms are keyed together by means of interfitting grooves 28 and ridges 29 formed respectively on the ends of the rollers 15 and on the pivot arms 22.

As shown in FIGS. 5 and 7 the pivot arms 22 may have open ends 30 by means of which the scrubber head 21 may be clip engaged on the axle 14. Alternatively, as shown in FIG. 6, the pivot arms 22 may be formed with closed ends which are apertured as at 31 for passage therethrough of the axle 14.

Details of the scrubber head are best seen in FIGS. 1 to 3, 8 and 9, to which reference should now be made. As shown in FIGS. 1 to 4B the scrubber head 21 has a pair of spaced apart pivot arms 22 fixedly connected by a bridging scrubber pad holder bar 32 to which is secured by means of an adhesive interface 33 a scrubber pad 34. When the scrubber pad is no longer serviceable from wear, the entire scrubber head 21 is replaced. Alternative structures are shown in FIGS. 8 and 9 which require only replacement of the scrubber pad itself. FIG. 9 shows the holder bar 32 as drilled and tapped to hold a set screw 35 which bears against the undersurface of a slide-on C-shaped carrier 36 upon which is secured a scrubber pad 37, the carrier and pad being quickly detachable and replaceable. FIG. 8 shows a modified form of holder bar 38 also carrying a set screw 39 which secures a slide out pad carrier 40 carrying a scrubber pad 41. As shown in phantom outline at 42 in FIG. 1, if desired, the scrubber pad holder bar and the scrubber pad can be extended in length.

Having now described the invention in connection with a particularly illustrated embodiment thereof, variations and modifications of the invention may now naturally occur to those persons normally skilled in the art without departing from the essential scope and spirit of the invention, and accordingly it is intended to claim the same broadly as well as specifically as indicated by the appended claims.

What is claimed to be new and useful is:

1. A scrubber head for use in combination with a wringer mop of the type having at least one rotatable wringer roller extending substantially orthogonally and in spatially fixed position to a mop handle, a mop head having a surface engagingly underlying the wringer roller and adapted to having its wringer engaging surface translated with respect to the roller to rotate the latter and wring out the mop head, and an actuating member effective to translate the wringer engaging surface of the mop head in opposite directions to effect opposite rotations of the roller and to alternately wring out the mop head and restore it to use position, said scrubber head comprising in combination, (a) a scrubber pad, (b) scrubber pad support means which mechanically support said scrubber pad, and (c) pivot means connected to said scrubber pad support means and being also couplable to the wringer roller of the wringer mop for rotation therewith when the wringer roller is rotated by the engaging surface of the mop head, said scrubber pad support means being pivoted up out of the way when the mop head actuating member moves the mop head into use position and being pivoted down into working scrubbing position when the mop head actuating member moves the mop head to wring it out.

2. The combination as set forth in claim 1 wherein said pivot means is couplable to the roller by capture means and is frictionally engaged with the roller so as to rotate with it.

3. The combination as set forth in claim 2 wherein said scrubber pad is adhesively secured to said scrubber pad support means.

4. The combination as set forth in claim 2 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

5. The combination as set forth in claim 1 wherein said pivot means is couplable to the roller by capture means and is key engaged with the roller so as to rotate with it.

6. The combination as set forth in claim 5 wherein said scrubber pad is adhesively secured to said scrubber pad support means.

7. The combination as set forth in claim 5 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

8. The combination as set forth in claim 1 wherein the wringer roller consists of an axle with hollow cylindrical roller segments of larger diameter mounted thereon and wherein said pivot means further includes capture means for holding itself captive to the roller axle and is frictionally engaged with the end face of an adjacent one of said cylindrical roller segments of larger diameter.

9. The combination as set forth in claim 8 wherein said scrubber pad is adhesively secured to said scrubber pad support means.

10. The combination as set forth in claim 8 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

11. The combination as set forth in claim 1 wherein the wringer roller consists of an axle with hollow cylindrical roller segments of larger diameter mounted thereon, and wherein said pivot means further includes capture means for holding itself captive to the roller axle, and is key engaged with the end face of an adjacent one of said cylindrical roller segments of larger diameter.

12. The combination as set forth in claim 11 wherein said scrubber pad is adhesively secured to said scrubber pad support means.

13. The combination as set forth in claim 11 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

14. The combination as set forth in claim 1 wherein said pivot means comprises a pair of spaced apart pivot arms each fixedly connected at one of their ends to a different place along said scrubber pad support means, and each having its other end couplable to the wringer roller at different places therealong.

15. The combination as set forth in claim 14 wherein said scrubber pad is adhesively secured to said scrubber pad support means.

16. The combination as set forth in claim 14 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

17. The combination as set forth in claim 14 wherein said pivot means pivot arms are couplable to the roller by capture means and are frictionally engaged with the roller so as to rotate with it.

18. The combination as set forth in claim 17 wherein said scrubber pad is adhesively secured to said scrubber pad support means.

19. The combination as set forth in claim 17 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

20. The combination as set forth in claim 14 wherein said pivot means pivot arms are couplable to the roller by capture means and are key engaged with the roller so as to rotate with it.

21. The combination as set forth in claim 20 wherein said scrubber pad is adhesively secured to said scrubber pad support means.

22. The combination as set forth in claim 20 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

23. The combination as set forth in claim 14 wherein the wringer roller consists of an axle with hollow cylindrical roller segments of larger diameter mounted thereon, and wherein said pivot means pivot arms each further includes capture means for holding itself captive to the roller axle and is frictionally engaged with the end face of an adjacent one of said cylindrical roller segments of larger diameter.

24. The combination as set forth in claim 23 wherein said scrubber pad is adhesively secured to said scrubber pad support means.

25. The combination as set forth in claim 23 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

26. The combination as set forth in claim 14 wherein the wringer roller consists of an axle with hollow cylindrical roller segments of larger diameter mounted thereon, and wherein said pivot means pivot arms each further includes capture means for holding itself captive to the roller axle and is key engaged with the end face of an adjacent one of said cylindrical roller segments of larger diameter.

27. The combination as set forth in claim 26 wherein said scrubber pad is adhesively secured to said scrubber pad support means.

28. The combination as set forth in claim 26 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

29. The combination as set forth in claim 1 wherein said scrubber pad is adhesively secured to said scrubber pad support means.

30. The combination as set forth in claim 1 wherein said scrubber pad is secured on a mount which captively interfits with said scrubber pad support means, and further including locking means carried by one of said scrubber pad support means and scrubber pad mount for releasably locking said scrubber pad mount to said scrubber pad support means.

* * * * *